US005751237A

United States Patent [19]

Tanaka

[11] Patent Number: 5,751,237

[45] Date of Patent: May 12, 1998

[54] TRIMMING UNIT OF RADIO CONTROL APPARATUS

[75] Inventor: Masahiro Tanaka, Mobara, Japan

[73] Assignee: Futaba Denshi Kogyo Kabushiki Kaisha, Mobara, Japan

[21] Appl. No.: 627,456

[22] Filed: Apr. 4, 1996

[30] Foreign Application Priority Data

Apr. 4, 1995 [JP] Japan ..... 7-101661

[51] Int. Cl.[6] ..... G08C 19/12

[52] U.S. Cl. ..... 341/176; 341/20; 341/26; 340/825.69; 364/423.099; 364/709.12

[58] Field of Search ..... 341/176, 20, 22, 341/23, 26, 34; 364/423.099, 424.012, 709.12; 340/825.69; 318/16, 581, 603

[56] References Cited

U.S. PATENT DOCUMENTS 3,906,369 9/1975 Pitman et al. ..... 341/20

4,203,063 5/1980 Loeb et al. ..... 318/603

4,739,311 4/1988 Yamamoto et al. ..... 341/176

*Primary Examiner*—Jeffery Hofsass

*Assistant Examiner*—Andrew Hill

*Attorney, Agent, or Firm*—Oblon, Spivak, McClelland, Maier & Neustadt, P.C.

[57] ABSTRACT

A trim unit having a simple structure is provided which has an arrangement such that an automatic repeating function is activated when a trim switch is depressed continuously. If a determination is performed in step S40 that count value CNT (1) of a first counter is larger than N3, then the value of CNT (1) is set to N2+CNT (2) so that count value CNT (2) of a second counter is increased. Then, the trimming position is moved by one step in step S80. If the trim switch is continuously depressed, the interval for the count value CNT (1) to be larger than N3 in shortened in accordance with the count value CNT (2). Thus, the repeating speed for the trimming position to be moved is raised so that the trimming position is quickly adjusted.

3 Claims, 5 Drawing Sheets

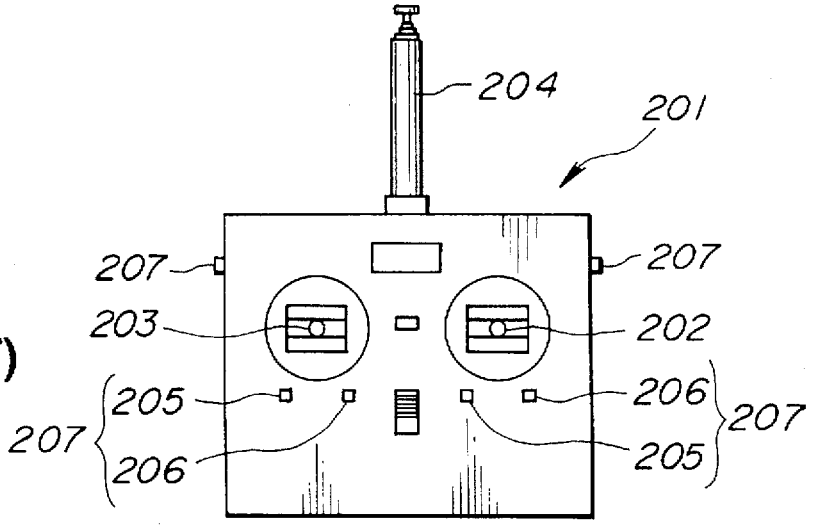
FIG.2(a)
(PRIOR ART)
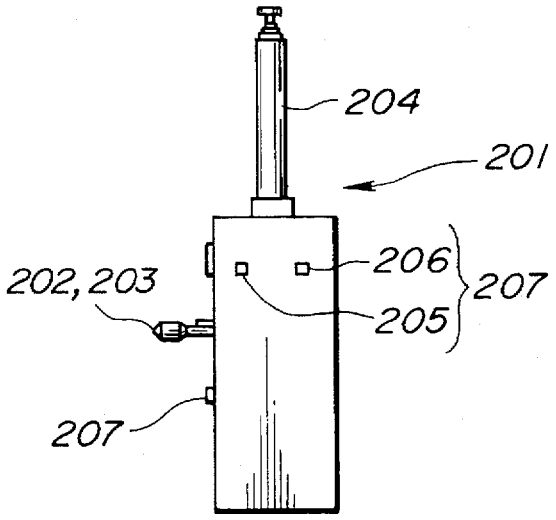
FIG.2(b)
(PRIOR ART)
FIG.3
(PRIOR ART)
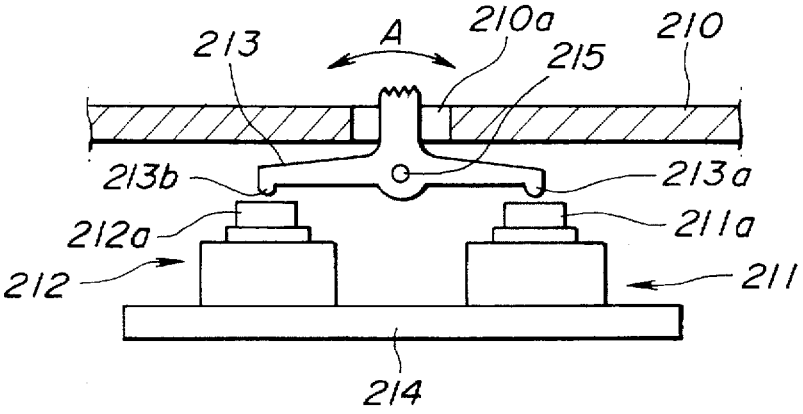

TRIMMING UNIT OF RADIO CONTROL APPARATUS

BACKGROUND OF THE INVENTION

1. Field of the Invention

The present invention relates to a trimming unit for adjusting the neutral position of a control lever of a radio control apparatus.

2. Related Background Art

An analog-type slide trimming unit of a radio control apparatus is shown in FIG. 1.

In the slide trimming unit shown in FIG. 1, reference numeral 102 represents a variable resistor, the resistance value of which is varied when a control lever (stick) 101 for controlling ailerons of the wings is operated. Reference numeral 103 represents a variable resistor, the resistance value of which is varied when the control lever 101 for controlling elevators of horizontal tails is operated. Reference numeral 104 represents a variable resistor, the resistance value of which is varied when a control lever 101' for controlling an engine throttle is operated.

Reference numeral 111 represents a variable resistor, the resistance value of which is varied when a trim adjuster 108 is operated, 112 represents a variable resistor, the resistance value of which is varied when a trim adjuster 109 is operated, and 113 represents a variable resistor, the resistance value of which is varied when a trim adjuster 110 is operated.

Voltage E1 output from the variable resistor 102 and voltage e1 output from the variable resistor 111 are added to each other by an adder 105 so that voltage (E1+e1) is applied to a multiplexer 114. Voltage E2 output from the variable resistor 103 and voltage e2 output from the variable resistor 112 are added to each other by an adder 108 so that voltage (E2+e2) is applied to the multiplexer 114. Voltage E3 output from the variable resistor 104 and voltage e3 output from the variable resistor 113 are added to each other by an adder 107 so that voltage (E3+e3) is applied to the multiplexer 114.

The multiplexer 114, for each channel, selects voltage signals transmitted from the adders 105, 106 and 107 to supply the selected signals to an analog-to-digital (A/D) converter 115. The supplied voltage signals are converted into parallel digital signals C1 and C0 by the A/D converter 115. The parallel digital signals C1 and C0 are, in a serializer 116, formed into series digital signal C2 for each channel so as to be transmitted from a radio transmitter 117 through an antenna 117*a*. The transmitted signal is received by a receiver mounted on a model airplane or the like so that the model airplane can be operated.

In order to cause the subject to be controlled, for example, the model airplane, to fly straight when the operator releases the hand from the control level of the radio control apparatus, the slide trimming unit is adjusted. As a result, the control lever of the radio control apparatus is set to a neutral state.

Since radio control apparatuses developed recently have been digitized, the foregoing analog-type slide trimming unit encounters a problem in that a complicated circuit is required because conversions to digital signals by using the A/D converter 115 must be performed.

Moreover, the variable resistor is unsatisfactory in view of the reliability when used for a long time.

Accordingly, a digital-type button trim has been suggested which does not need the A/D converter 115 and the like. FIG. 2A is a front view of a body 201 of a radio control apparatus to which the button trim is applied, and FIG. 2B is a side view of the same.

Referring to FIGS. 2A and 2B, reference numerals 202 and 203 represent control levers. A button trim 207 for adjusting the control levers 202 and 203 is composed of a pair of button switches 205 and 206. Moreover, a rod antenna 204 for transmitting control radio waves is disposed on the top surface of the body 201. Also the side surface of the body 201 has a button trim 207 disposed thereon. Thus, button trims 207 for totaling four channels are disposed on the body 201.

Note that the button switch 205 enlarges the quantity of trimming and the button switch 206 reduces the quantity of trimming.

FIG. 3 is an enlarged cross sectional view of a button trim 207 capable of operating a pair of button switches by one lever. The button trim 207 consists of two push button switches 211 and 212 and a lever 213 for selectively operating the push button switch 211 or the push button switch 212.

The push button switches 211 and 212 are push button switches for respectively enlarging and reducing the quantity of trimming. Each of the push-buttons 211 and 212 is formed into a two-step-type switch. In the foregoing case, either of the push button switch 211 or the push button switch 212 is selected and operated in accordance with the rotational direction (A) of the lever 213.

The push button switch 211 will now be described for instance. As shown in FIG. 4A, the push button switch 211 is formed into the two-step-type switch. When the push button switch 211 is operated, a first switch is closed, and then a second switch is closed when the push button switch 211 is further depressed. Switch signals transmitted from the first and second switches are supplied to an I/O port of a microprocessor (a CPU). If the operation state of the push button switch 211 supplied through the I/O port is continued, an automatic repeating function acts so that the quantity of trimming is enlarged or reduced by a predetermined step at each repeating timing.

In the foregoing case, the repeating speed is raised so that the quantity of trimming is changed at higher speed in a case where the first and second switches of the push button switch 211 are closed as compared with a case where only the first switch of the same is closed as shown in FIG. 4B.

The reason why the button switch is formed into the two-step-type switch will now be described. When, for example, a model airplane is allowed to descend and landed, the engine throttle is completely closed so that the engine is turned off. The engine throttle is arranged to be throttled to realize the lowest engine speed when the control lever for controlling the engine throttle is positioned at the lowest position. When the button trim is, at this time, operated to minimize the quantity of trimming, the engine throttle is closed so that the engine is turned off. Since the engine must quickly be turned off when the model airplane is landed, the repeating timing must be shortened.

However, the foregoing conventional digital-type button trim comprising the two-step switch which uses two I/O ports, requires 16 (2-input×2 directions×4 channels) ports if a four-channel structure is employed. Thus, there arises a problem in that I/O ports having a multiplicity of inputs are required.

Since the conventional structure comprises the two-step switch, the CPU must monitor the switch having a multiplicity of steps. Thus, the CPU must bear heavy load and the time for performing other calculation processes is shortened, thus resulting in a problem to arise in that a costly high-speed CPU is required.

SUMMARY OF THE INVENTION

Accordingly, an object of the present invention is to provide a trimming unit of a radio control apparatus having a structure such that only one switch is provided for one button trim and thus exhibiting improved operation facility.

To achieve the foregoing object, according to one aspect of the present invention, there is provided a trimming unit of a radio control apparatus comprising: a trim switch having only a pair of contacts; control means for detecting a fact that time in which the trim switch is continuously operated is longer than a predetermined time so as to activate an automatic repeating function and controlling repeating speed of the activated automatic repeating function, wherein the control means raises the repeating speed as the detected time in which the trim switch is continuously operated is elongated.

The foregoing radio control apparatus has a structure such that the repeating speed is linearly raised as the detected time in which the trim switch is continuously operated is elongated.

The foregoing radio control apparatus also has a structure such that the repeating speed is non-linearly raised as the detected time in which the trim switch is continuously operated is elongated.

According to the present invention, the repeating speed of the automatic repeating function can be raised in accordance with the time in which the continuous operation is performed even if only one switch is provided for the button trim. Therefore, the quantity of trimming, which is enlarged by each step whenever repeating is performed, can quickly be changed.

Therefore, the necessity of providing a multiplicity of I/O ports can be eliminated. Thus, load to be borne by the CPU can be reduced and a low cost CPU can be employed.

BRIEF DESCRIPTION OF THE DRAWINGS

These and other objects and many of the attendant advantages of the present invention will be readily appreciated as the same becomes better understood by reference to the following detailed description when considered in connection with the accompanying drawings;

wherein:

FIGS. 2A and 2B are diagrams showing the body of a transmitter of a radio control apparatus having the conventional button trim;

FIG. 3 is a diagram showing the structure of a switch of the conventional button trim;

DETAILED DESCRIPTION OF THE PREFERRED EMBODIMENT

Figure 1:
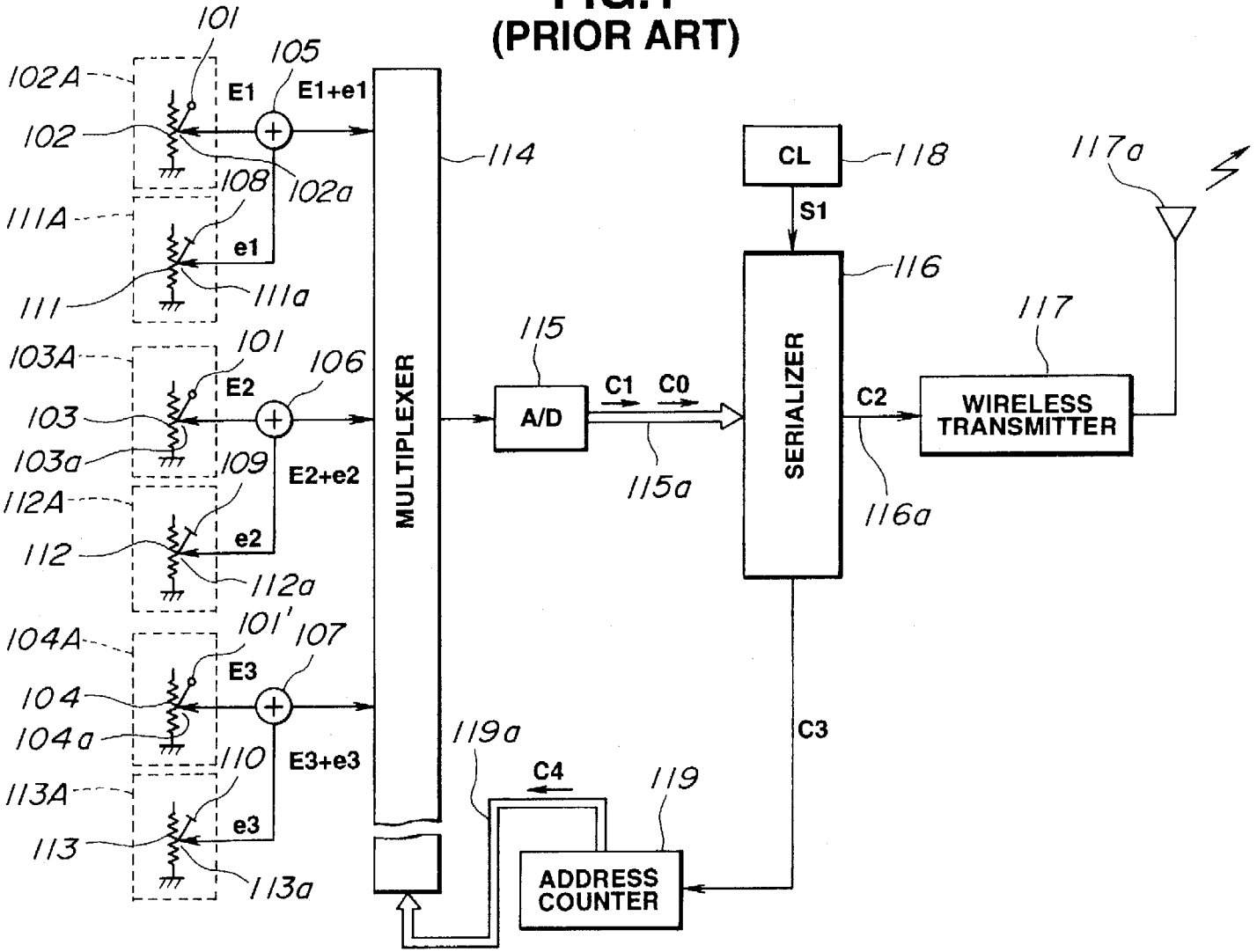
FIG.1 (PRIOR ART)
FIG. 1 is a block diagram showing the structure of a conventional analog slide trim.
Figure 4A:
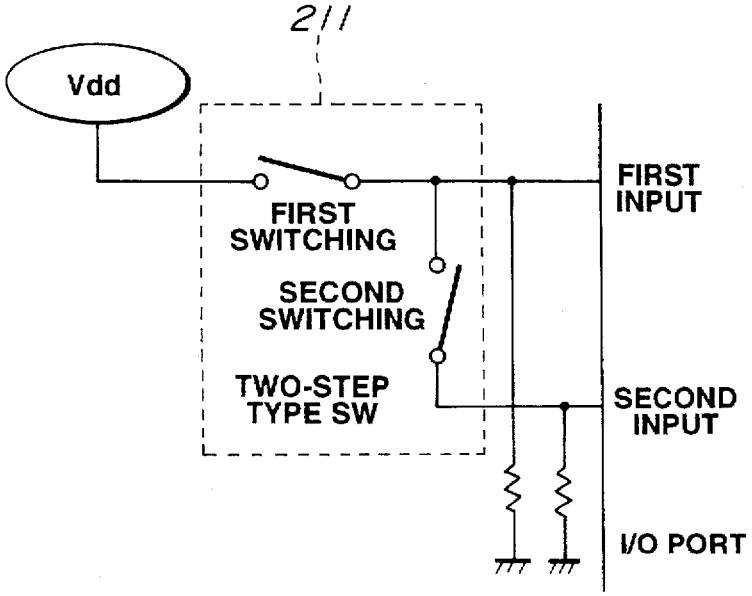
FIG.4(a) (PRIOR ART)
FIGS. 4A and 4B are a diagram showing a switch circuit and a graph showing the operation characteristic of a switch of the conventional button trim.
Figure 4B:
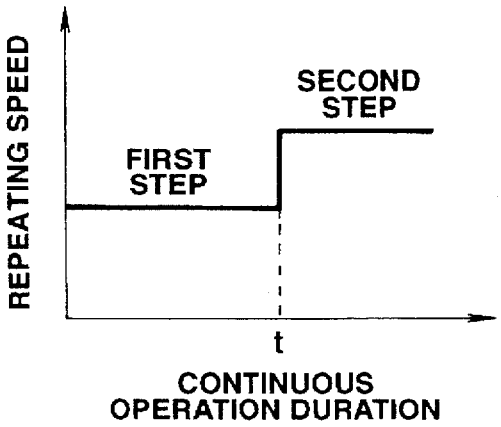
FIG.4(b) (PRIOR ART)
Figure 5:
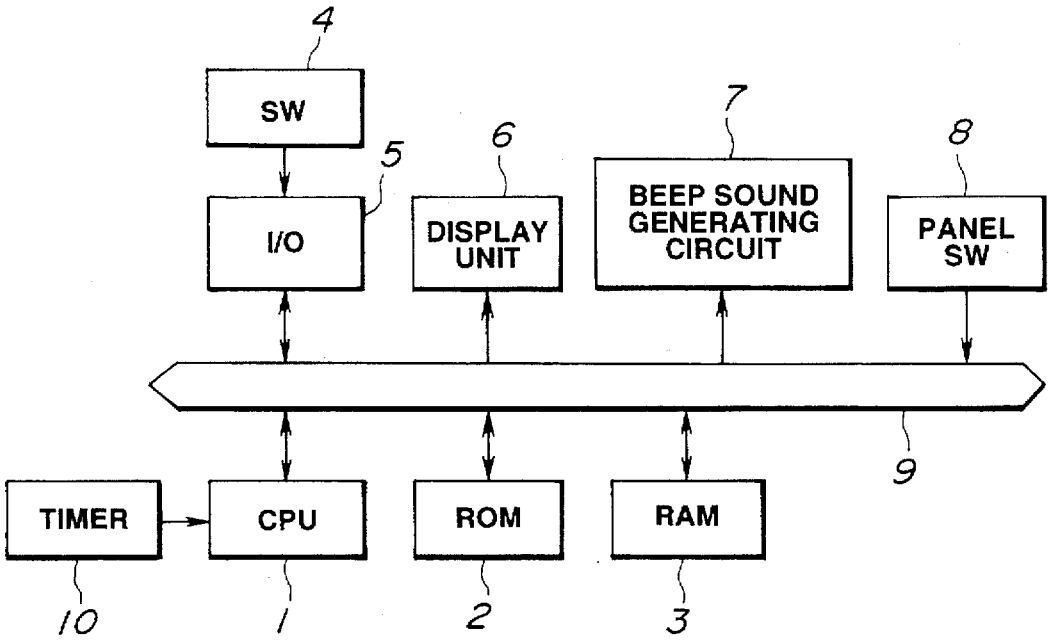
FIG. 5 in a block diagram showing an example of a trimming unit of a radio control apparatus according to the present invention.

FIG. 5 is a block diagram showing an example of a portion concerning a trimming unit of a radio control apparatus according to the present invention.

Referring to FIG. 5, a microprocessor (a CPU) 1 performs a variety of processes including control of the quantity of trimming in accordance with a program stored in a ROM (Read Only Memory) 2. In the foregoing case, a portion of the memory area of a RAM (Random Access Memory) 3 is used as a working area.

A button trim comprises a trim switch 4 connected to the input of a bus 9 through an I/O port 5 so that the state of the trim switch 4 is detected by the CPU 1. Moreover, the state where the button trim is controlled is displayed on a display unit 6.

If continuation of depression of the trim switch 4 is detected by the CPU 1, an automatic repeating function is activated. Whenever repeating is performed due to the automatic repeating function, beep sound is generated in a beep sound generating circuit 7. A panel switch 8 has switches for selecting display on the display 6 and changing settings of the parameters.

Moreover, a timer 10 is provided for interrupting the CPU 1 at every predetermined time determined by the CPU 1 so that a timer interruption process is performed in the CPU 1.

Figure 6:
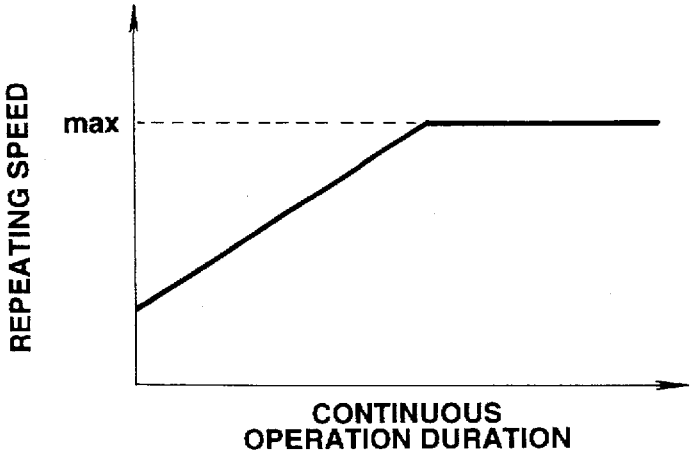
FIG. 6 is a graph showing the operation characteristic of the trimming unit of the radio control apparatus according to the present invention.

In the button trim structured as described above, when the trim switch 4 is operated continuously, the automatic repeating function is activated so that the quantity of trimming is enlarged or reduced by a predetermined step at each repeating timing. As the time in which the continuous operation is performed is elongated, the repeating speed is linearly raised to the maximum speed (max), as shown in FIG. 6. That is, the change in the quantity of trimming per unit time is enlarged so that the quantity of trimming is quickly adjusted. As a result, a satisfactory control can be performed in a case where a model of, for example, an airplane, is landed.

When the quantity of trimming is changed by intermittently operating the trim switch 4 to prevent the continuous operation, the quantity of trimming can precisely be adjusted.

Figure 7:
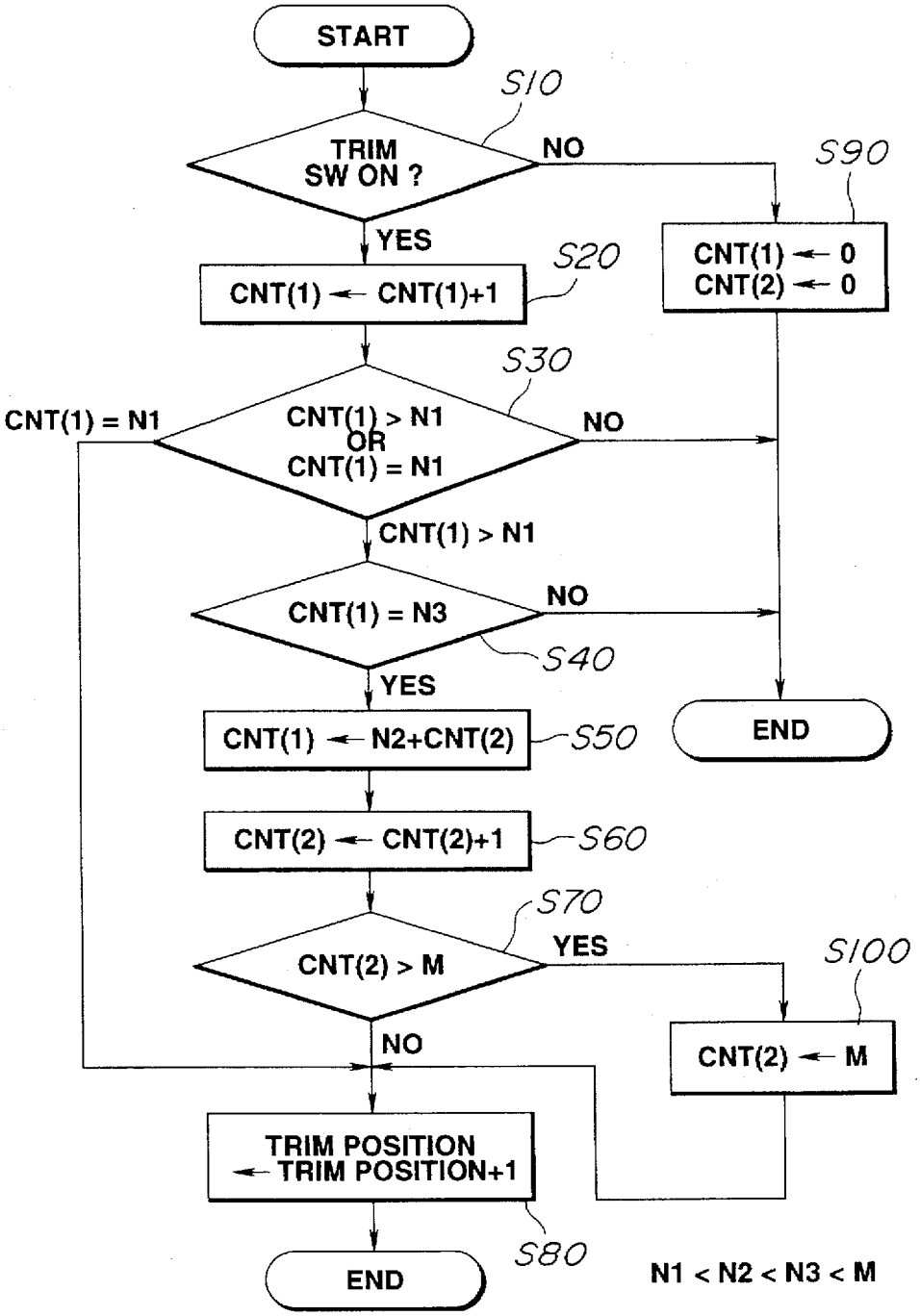
FIG. 7 is a flow chart of a routine of a timer interruption process showing the operation of the trimming unit of the radio control apparatus according to the present invention.

The operation of the trimming unit of the radio control apparatus according to the present invention will now be described in detail with reference to a flow chart of a routine for a timer interruption process shown in FIG. 7.

When the timer interruption process routine has been started due to the interruption performed by the timer 10, whether or not the trim switch (SW) 4 has been switched on is determined in step S10. If the trim switch 4 has been operated, the trim switch 4 transmits, for example, a high level signal. Thus, a determination Is performed that the trim switch 4 has been switched on, and the operation proceeds to step S20.

If the trim switch 4 has not been operated and thus a low level signal has been transmitted from the same, a determination is performed that the trim switch 4 has not been switched on. Thus, the operation is branched to step S90 so that a first counter CNT (1) and a second counter CNT (2) are reset to zero. Then, the foregoing routine is ended.

If the operation has proceeded to step S20, only the count value CNT (1) of the first counter is increased by one. The first counter is a virtual counter realized by the CPU 1, count value CNT (1) counted by the first counter being stored in a register formed by the memory area of the RAM 3.

In step S30 whether or not the count value CNT (1) of the first counter is larger than a predetermined value N1 or the same as N1 is determined. Since the count value is smaller than N1 immediately after the trim switch 4 has been operated, the routine is ended as it is. The count value CNT (1) of the first counter is increased by one whenever the timer interruption process is performed. If the timer interruption processes are performed by a predetermined number of times in a state where the trim switch 4 is continuously switched on, the count value CNT (1) reaches the predetermined value N1.

Thus, a determination is performed that CNT (1)=N1, and then the operation proceeds to step S80 so that the trimming position is set forward by one step and the routine is ended here. If the state where the trim switch 4 is switched on is maintained and a next timer interruption process is performed, then a determination is performed that the count value CNT (1) of the first counter is larger than N1. Thus, the operation proceeds to step S40.

In step S40 whether or not the count value CNT (1) of the first counter is the same as a predetermined value N3 is determined. Since N1<N3 is held here, a determination is performed that the count value has not reached the predetermined value N3. Thus, the routine is ended here.

If the timer interruption processes are continuously performed by a predetermined number of times in a state where the state where the trim switch 4 is switched on is maintained, the count value CNT (1) of the first counter, which is increased whenever the timer interruption process is performed, is made to be the same as N3. Thus, the operation proceeds to step S50 so that the value of N2+CNT (2) is initialized into the first counter. In the foregoing case, the initial value of the count value CNT (2) of the second counter is "0" and N2 is a predetermined value between N1 and N3.

In step S60 the count value CNT (2) of the second counter is increased by only one. In step S70 whether or not the count value CNT (2) of the second counter is larger than maximum value M is determined. Since the count value CNT (2) of the second counter is made to be "1" in the foregoing case, a determination is performed that the count value CNT (2) of the second counter is not larger than M. Thus, the operation proceeds to step S80 so that the trimming position is set forward by one step.

Although omitted from the description about the foregoing routine, the trim adjustment position displayed on the display unit 6 is set forward by one step and beep sound is generated by a beep sound generating circuit 7.

If the timer interruption processes are performed by several times in such a manner that the state where the trim switch 4 is switched on is maintained, a determination is, in step S40, performed that the count value CNT (1) is made to be again the same as N3. Thus, the value of N2+CNT (2) is, as the initial value, set to the first counter. Since the count value CNT (2) of the second counter is made to be "1" in the foregoing case, a value larger than the foregoing value by one is set to the first counter.

In a case where the timer interruption process is further performed, the count value CNT (1) of the first counter reaches N3 even if the number of the timer interruption processes is smaller than that in the previous case by one. Since the count value CNT (2) of the second counter is increased by one whenever the count value CNT (1) of the first counter reaches N3, the number of the timer interruption processes {N3−N2−CNT (2)} to be performed until the count value CNT (1) of the first counter reaches N3 is decreased during the period in which the timer interruption process is performed.

Whenever the count value CNT (1) of the first counter reaches N3, the trimming position is set forward by one step in step S80. Therefore, the timing at which the trimming position is set forward is gradually shortened. If the trim switch 4 is continuously operated, the speed at which the trimming position is changed is raised so that the adjustment of the trimming position is quickly performed.

If the count value CNT (2) of the second counter is larger than the maximum value M, this fact is determined in step S70. Thus, the operation proceeds to step S100 so that the count value CNT (2) of the second counter is set to M. As a result, the speed at which the trimming position is changed is saturated as shown in FIG. 2.

Note that M, N3, N2 and N1 hold the relationship M>N3>N2>N1.

As described above, the button trim according to the present invention has the structure such that, in a case where the trim switch 4 is continuously operated, the first counter continues counting until the count value CNT (1) of the first counter reaches the predetermined value N1. The reason for this is that an influence of chattering of the trim switch 4 must be eliminated.

When the count value CNT (1) of the first counter reaches N2, the automatic repeating function is activated so that counting of the first counter is continued.

When the count value CNT (1) of the first counter has reached N3, each of the trimming position and that displayed on the display unit 6 is set forward by one step. The count value CNT (1) of the first counter is, as the initial value, set to be a value expressed as N2+CNT (2). Counting of the first counter is continued. When the count value CNT (1) of the first counter has again reached N3, each of the trimming position and that displayed on the display unit 6 is set forward by one step. Moreover, the count value CNT (1) of the first counter is, as the initial value, again set to be a value expressed as N2+CNT (2).

The foregoing loop operation is repeated and the repeating speed is raised whenever the loop operation is repeated. Note that the repeating speed has an upper limit max as shown in FIG. 2.

If the trim switch 4 is repeatedly switched on, the count value CNT (1) of the first counter CNT (1) is reset in step S90 before it reaches N2. Therefore, the repeating function is not activated so that the trimming position can precisely be adjusted.

Although the trim switch according to the present invention has the structure such that a pair of the button for enlarging the quantity of trimming and the button for reducing the same is provided for each control lever, it is preferable that the trim switches be disposed on the front surface and the side surface of the body of the radio control apparatus as shown in FIG. 5 to improve the operating facility.

Since the present invention has the foregoing structure, the repeating speed of the automatic repeating function can be raised in accordance with the time in which the continuous operation is performed even if the trim switch is a single-step switch. Thus, the quantity of trimming, which is enlarged by each step whenever the repetition is performed, can be changed at high speed.

Therefore, the necessity of providing a multiplicity of I/O ports can be eliminated and, therefore, the load to be borne by the CPU can be reduced, and thus a low cost CPU can be employed.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A trimming unit of a radio control apparatus comprising:

a trim switch having only a pair of contacts;

control means for detecting a fact that time in which said trim switch is continuously operated is longer than a predetermined time so as to activate an automatic repeating function and controlling repeating speed of the activated automatic repeating function, wherein said control means raises the repeating speed as the detected time in which said trim switch is continuously operated is elongated.

2. A trimming unit of a radio control apparatus according to claim 1, wherein the repeating speed is linearly raised as the detected time in which said trim switch is continuously operated is elongated.

3. A trimming unit of a radio control apparatus according to claim 1, wherein the repeating speed is non-linearly raised as the detected time in which said trim switch is continuously operated is elongated.

* * * * *